US006874167B1

(12) United States Patent
Leszczynski

(10) Patent No.: US 6,874,167 B1
(45) Date of Patent: Apr. 5, 2005

(54) HAT MOUNTABLE FLAG

(76) Inventor: Christopher J. Leszczynski, 2298 Rollins St., Grand Blanc, MI (US) 48439

( * ) Notice: Subject to any disclaimer, the term of this patent is extended or adjusted under 35 U.S.C. 154(b) by 0 days.

(21) Appl. No.: 10/668,815

(22) Filed: Sep. 24, 2003

(51) Int. Cl.[7] ..... A42B 1/24
(52) U.S. Cl. ..... 2/209.13
(58) Field of Search ..... 2/209.13, 244; 24/3.1, 3.12; 40/329, 666

(56) References Cited

U.S. PATENT DOCUMENTS 4,349,246 A * 9/1982 Binner ..... 359/880
5,462,471 A 10/1995 Power-Fardy
5,530,970 A 7/1996 Knutson
5,572,836 A * 11/1996 Parker ..... 52/116
5,881,391 A * 3/1999 Mullaney ..... 2/209.13
5,896,585 A 4/1999 Stazo
5,903,925 A 5/1999 Engebretson
D438,820 S 3/2001 Goulding
6,247,205 B1 * 6/2001 Damadian et al. ..... 24/3.12
6,481,060 B1 * 11/2002 Tsai ..... 24/3.12
6,641,266 B1 * 11/2003 Lazarus ..... 351/155
2003/0051317 A1 * 3/2003 Preziosi et al. ..... 24/3.12
2004/0006900 A1 * 1/2004 Beller ..... 40/329

* cited by examiner

*Primary Examiner*—Katherine M Moran

(57) ABSTRACT

A hat mountable flag for removably positioning on a hat includes a rod that is elongated and has a first end and a second end. A flag is mounted on the rod. A fastener is attached to the second end of the rod for removably attaching the rod to the hat.

6 Claims, 3 Drawing Sheets

HAT MOUNTABLE FLAG

BACKGROUND OF THE INVENTION

1. Field of the Invention

The present invention relates to hat mountable devices and more particularly pertains to a new hat mountable device for mounting a flag on a hat.

2. Description of the Prior Art

The use of hat mountable devices is known in the prior art. While these devices fulfill their respective, particular objectives and requirements, the need remains for a device that resembles a flag and is easily mountable to on varying portions of a hat.

SUMMARY OF THE INVENTION

The present invention meets the needs presented above by comprising a rod that is elongated and has a first end and a second end. A flag is mounted on the rod. A fastener is attached to the second end of the rod for removably attaching the rod to a hat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
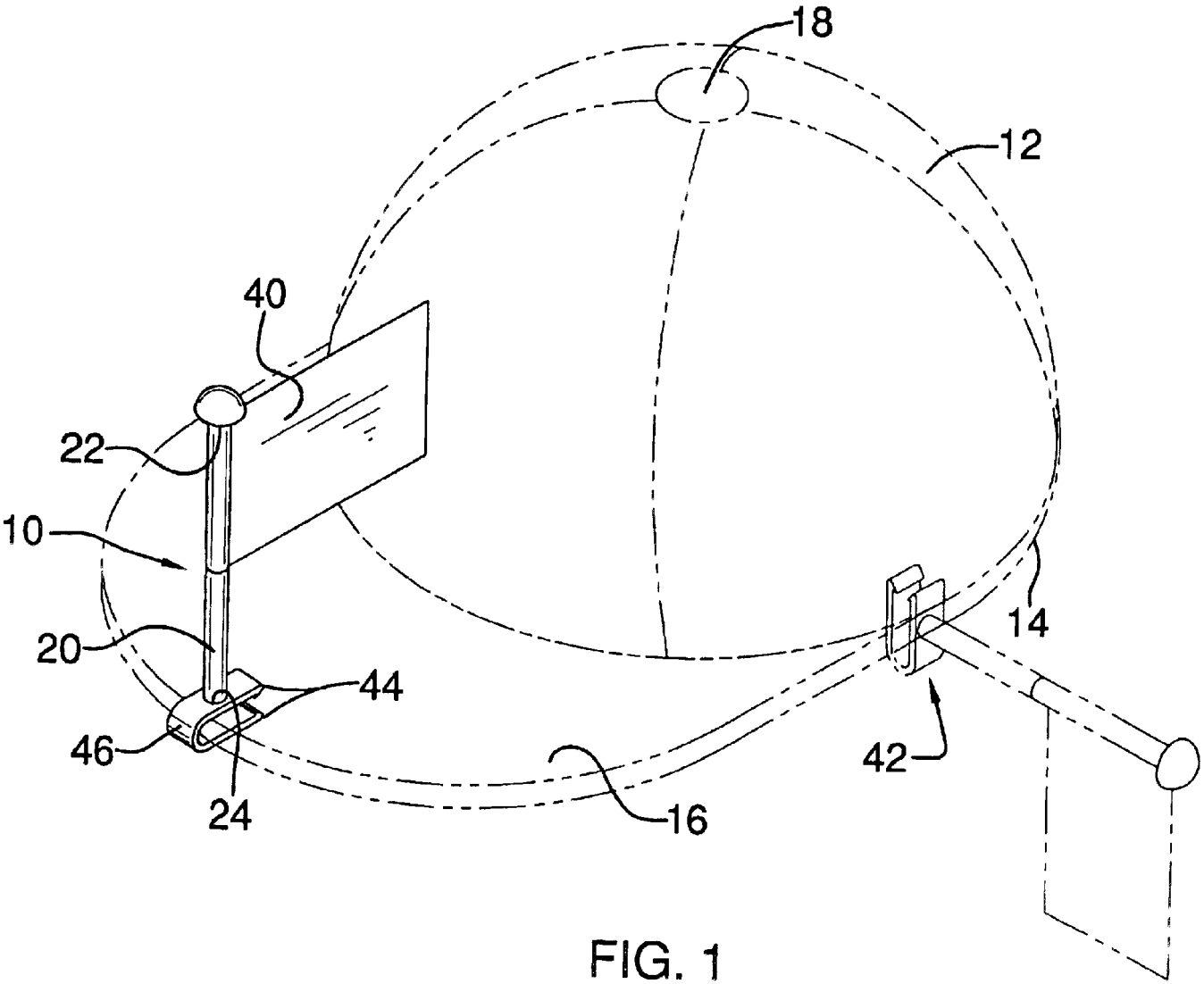
FIG. 1 is a schematic perspective view of a hat mountable flag according to the present invention.
Figure 2:
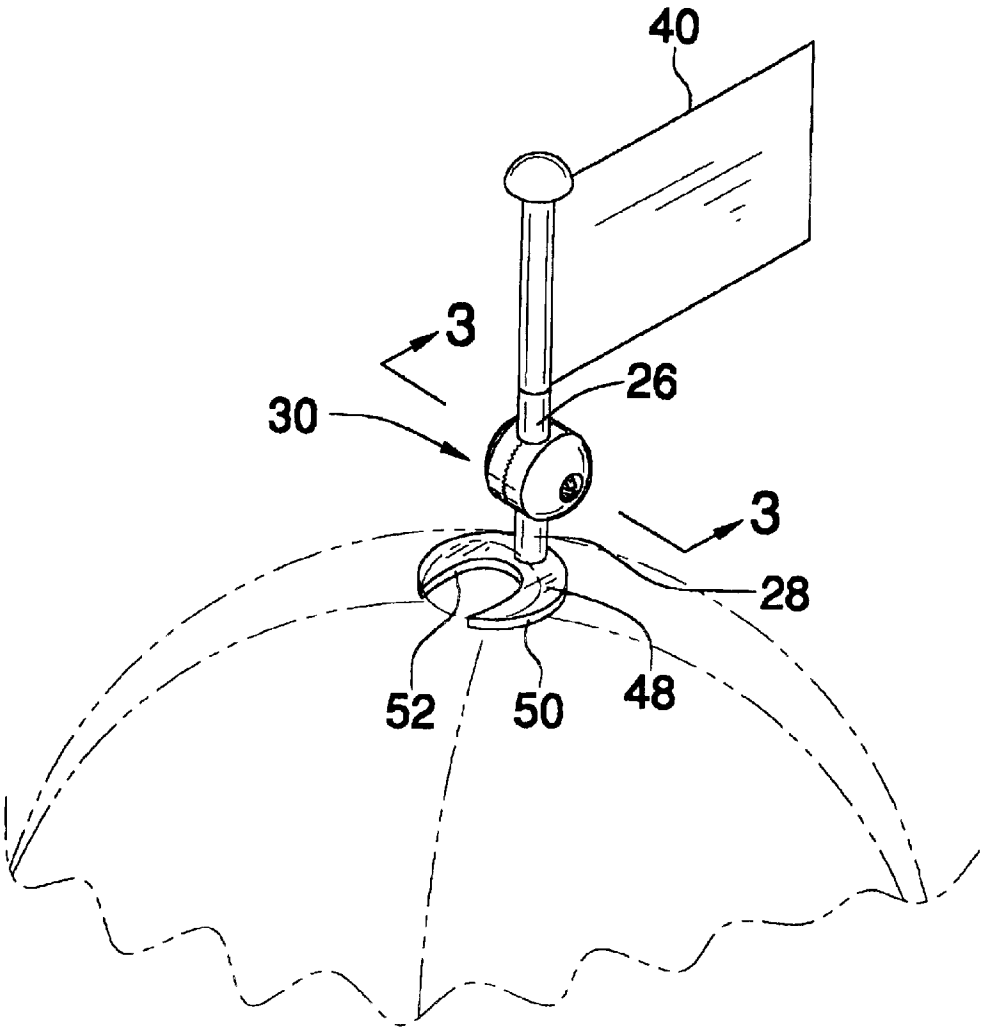
FIG. 2 is a schematic perspective view of a second embodiment of the present invention.
Figure 3:
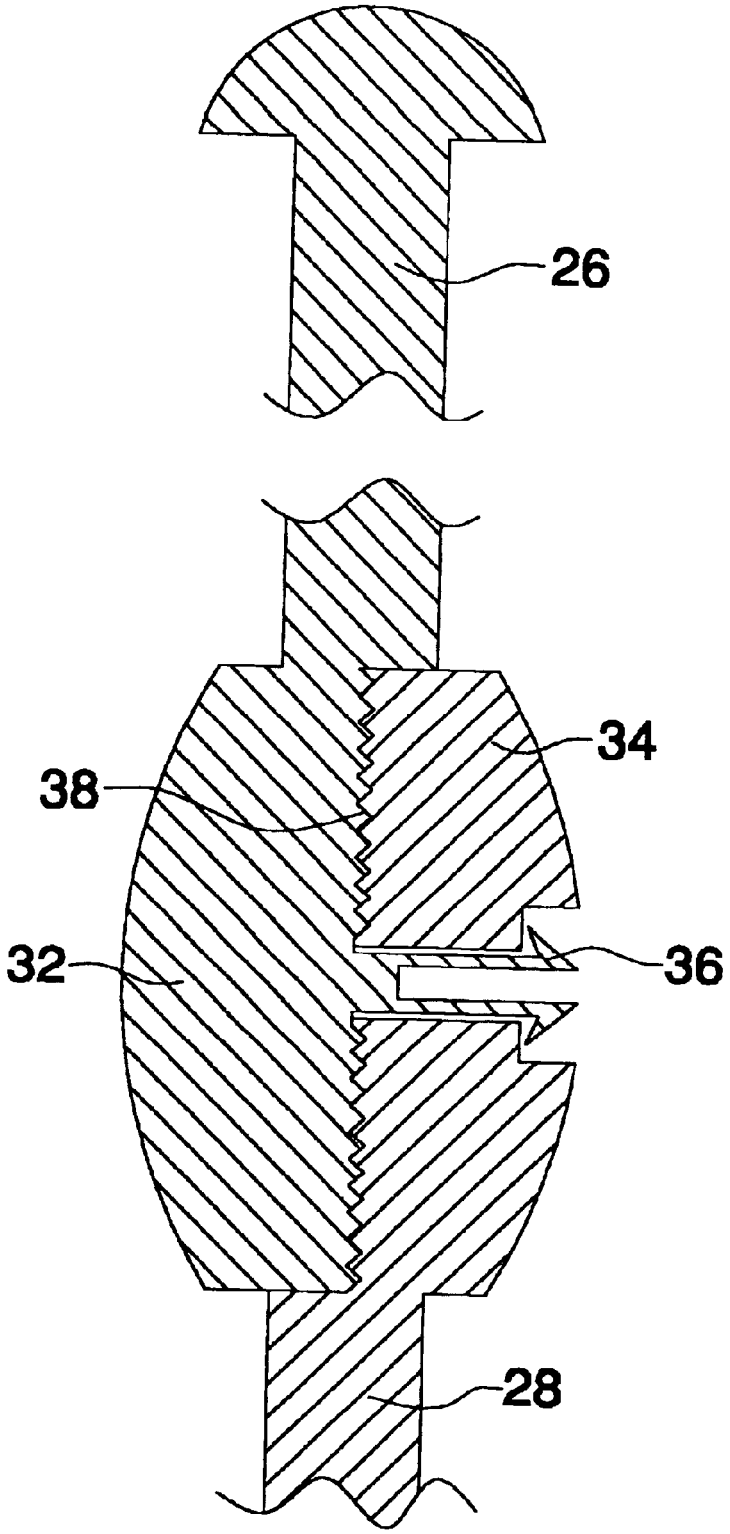
FIG. 3 is a schematic cross-sectional view taken along line 3—3 of FIG. 2 of the present invention.

With reference now to the drawings, and in particular to FIGS. 1 through 3 thereof, a new hat mountable device embodying the principles and concepts of the present invention and generally designated by the reference numeral 10 will be described.

As best illustrated in FIGS. 1 through 3, the hat mountable flag generally comprises a device 10 that is removably positionable on a hat 12, and ideally a baseball cap type hat. The baseball cap includes a perimeter edge 14 having a brim 16 attached thereto and an upper button 18 positioned at an apex of the hat 12.

The device 10 includes a rod 20 that is elongated and has a first end 22 and a second end 24. In a second embodiment of the device 10, the rod 20 has a break therein such that a first section 26 and a second section 28 of the rod 20 is defined. A coupler 30 is attached to the first 26 and second 28 sections for pivotally coupling the first 26 and second 28 sections together such that an angle between the first 26 and second 28 sections may selectively be chosen. The angle that may be selected is generally from 45 degrees to 180 degrees. The coupler 30 preferably includes a first portion 32 and a second portion 34 pivotally coupled together by a pin 36. Each of the first 32 and second 34 portions have an inner surface having teeth 38 thereon such that the first 32 and second 34 portions are frictionally coupled together. This allows the selected angle to be retained until the user of the device 10 desires to change the angle.

A flag 40 is mounted on the rod 20 and the flag 40 is positioned generally adjacent to the first end 22 of the rod 20. Preferably, the flag 40 comprises a rigid material and extends outwardly away from the rod 20. Typically, the flag 40 would have indicia printed thereon that may include sports teams, advertising or other indicia.

A fastener 42 is attached to the second end 24 of the rod 20 for removably attaching the rod 20 to the hat 12. In a first embodiment shown in FIG. 1, the fastener 42 includes a U-shaped clip having a pair of legs 44 and a central section 46 extending between the legs 44. The rod 20 is attached to one of the legs 44 such that a longitudinal axis of the rod 20 extends through each of the legs 44. This type of fastener is used for attaching the device to the perimeter edge 14 or brim 16 of the hat 12. In the second embodiment, shown in FIG. 2, the fastener 42 includes a plate 48 attached to the rod 20. The plate 48 is positioned in a plane orientated generally perpendicular to the longitudinal axis of the rod 20. The plate 48 has a peripheral edge 50 having a slot 52 extending therein for removably receiving the upper button 18 of the hat 12.

In use, the device 10 is selectively positioned on a hat 12, such as a baseball cap, for advertisement purposes, cheering on a sports team, or for novelty purposes. The rod 20 may be selectively angled for individualizing the device 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flag and hat combination device comprising:

a baseball cap having a brim and apex having a button attached thereto;

a rod being elongated and having a first end and a second end, said rod having a break therein such that a first section and a second section of said rod is defined, a coupler being attached to said first and second sections for pivotally coupling said first and second sections together such that an angle between said first and second sections may selectively be chosen, said coupler including a first portion attached to said first section and a second portion attached to said second portion, a pin extending through and pivotally coupling together said first and second portions, each of said first and second portions having an inner surface having teeth thereon such that said first and second portions are frictionally coupled together, said angle being generally from 45 degrees to 180 degrees;

a flag being mounted on said rod; and a fastener being attached to said second end of said rod for removably attaching said rod to the hat.

2. The device of claim 1, wherein said flag comprises a rigid material and extends outwardly away from said rod.

3. The device of claim 2, wherein said fastener includes a U-shaped clip having a pair of legs and a central section extending between said legs, said rod being attached to one of said legs such that a longitudinal axis of said rod extends through each of said legs.

4. The device of claim 1, wherein said fastener includes a U-shaped clip having a pair of legs and a central section extending between said legs, said rod being attached to one of said legs such that a longitudinal axis of said rod extends through each of said legs.

5. The device of claim 1, wherein said fastener includes a plate attached to said rod, said plate being positioned in a plane orientated generally perpendicular to a longitudinal axis of said rod, said plate having a peripheral edge having a slot extending therein.

6. A flag and hat combination device comprising:

a rod being elongated and having a first end and second end, said rod having a break therein such that a first section and a second section of said rod is defined, a coupler being attached to said first and second sections for pivotally coupling said first and second sections together such that an angle between said first and second sections may selectively be chosen, said angle being generally from 45 degrees to 180 degrees;

a flag being mounted on said rod, said flag being positioned generally adjacent to said first end of said rod, said flag comprising a rigid material and extending outwardly away from said rod; and a fastener being attached to said second end of said rod for removably attaching said rod to the hat, said fastener including a U-shaped clip having a pair of legs and a central section extending between said legs, said rod being attached to one of said legs such that a longitudinal axis of said rod extends through each of said legs.

* * * * *